US005160158A

United States Patent [19]

Scherübl

[11] Patent Number: 5,160,158

[45] Date of Patent: Nov. 3, 1992

[54] MULTI-PLY SKI

[75] Inventor: Franz Scherübl, Radstadt, Austria

[73] Assignee: Atomic Skifabrik Alois Rohrmoser, Wagrain, Austria

[21] Appl. No.: 665,022

[22] Filed: Mar. 5, 1991

[30] Foreign Application Priority Data

Mar. 9, 1990 [AT] Austria ..... 575/90

[51] Int. Cl.[5] ..... A63C 5/14

[52] U.S. Cl. ..... 280/610

[58] Field of Search ..... 280/610, 601, 602, 607; 428/343

[56] References Cited

U.S. PATENT DOCUMENTS

| | | | |
|---|---|---|---|
| 3,322,435 | 5/1967 | Kirschner | 280/610 |
| 3,369,821 | 2/1968 | Weber | 280/610 |
| 3,628,802 | 12/1971 | Hashimoto et al. | 280/610 |
| 3,635,482 | 1/1972 | Holman | 280/610 |
| 3,635,483 | 1/1972 | Barriball et al. | 280/610 |
| 3,816,573 | 6/1974 | Hashimoto et al. | 280/610 |
| 4,953,885 | 9/1990 | Comert et al. | 280/610 |

FOREIGN PATENT DOCUMENTS

| | | | |
|---|---|---|---|
| 177357 | 1/1954 | Austria | 280/610 |
| 272165 | 6/1969 | Austria | 280/610 |
| 2623010 | 12/1976 | Fed. Rep. of Germany | 280/610 |
| 3012309 | 10/1981 | Fed. Rep. of Germany | 280/610 |
| 3822900 | 1/1990 | Fed. Rep. of Germany . | |

*Primary Examiner*—David M. Mitchell
*Assistant Examiner*—Michael Mar
*Attorney, Agent, or Firm*—Collard & Roe

[57] ABSTRACT

A multi-ply ski with a top strap and a bottom strap. A core is arranged between the straps. The core is connected with plies of the top and bottom straps facing it via an adhesive layer. Side walls are arranged on both sides of the core. The side walls and the adhesive layer are formed by a foam plastic.

14 Claims, 4 Drawing Sheets

Fig. 5
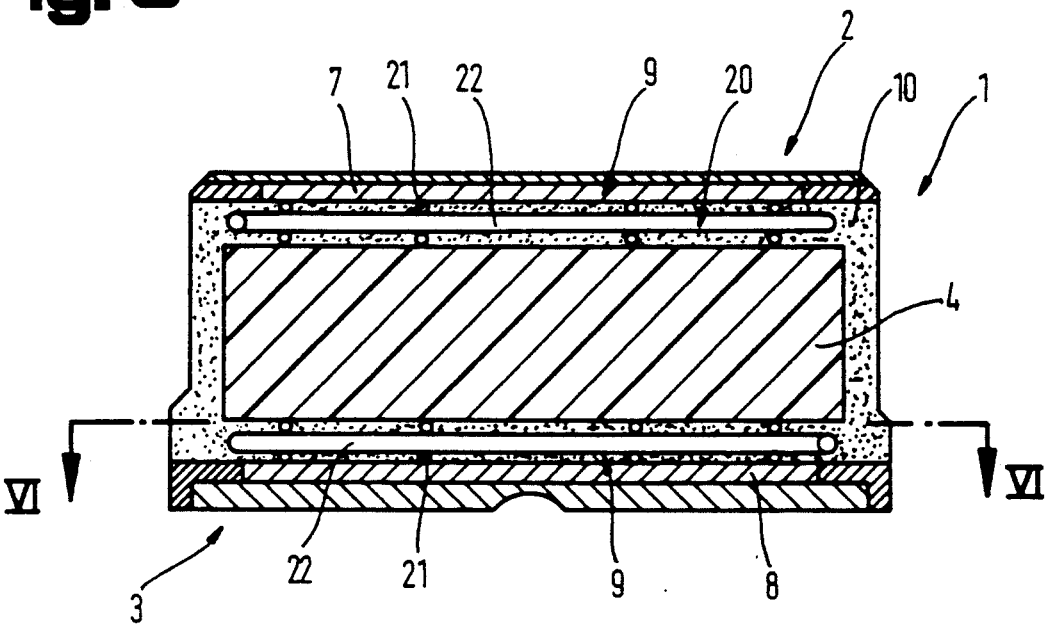
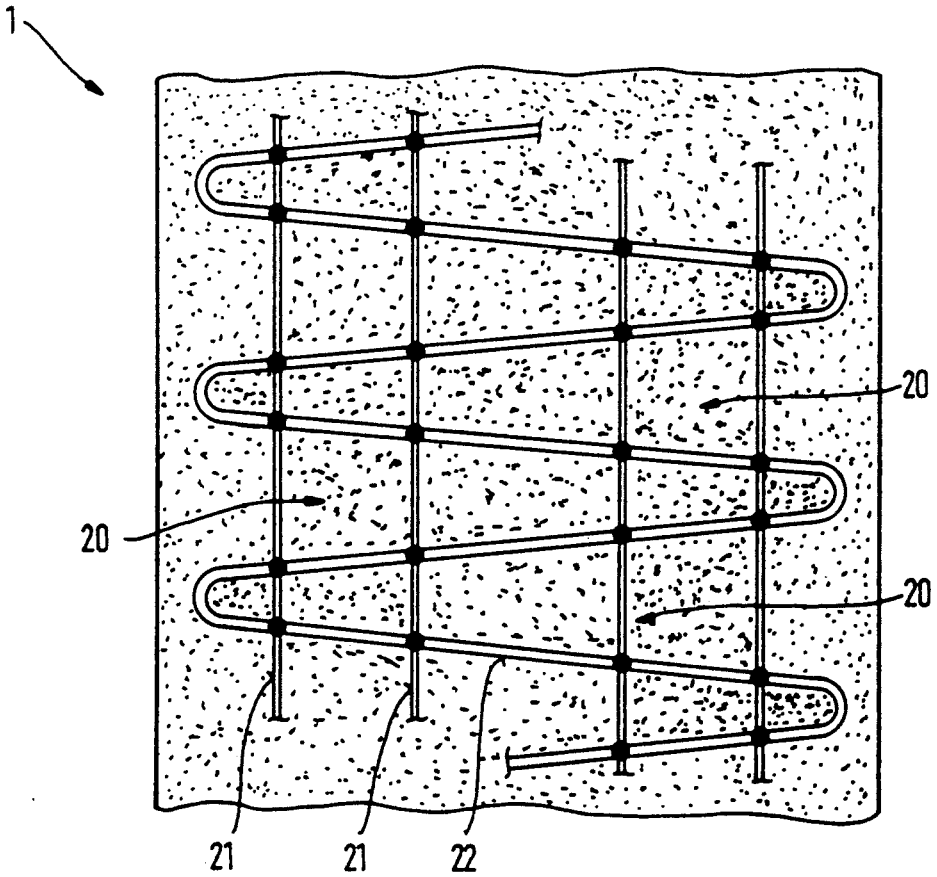
Fig. 6

MULTI-PLY SKI

BACKGROUND OF THE INVENTION

The invention relates to a ski with a core encased between a top strap and a bottom strap. The core is bonded to plies of the top and bottom strap by an adhesive layer. Side walls are arranged on either side of the core.

A ski or ski-like piece of sports equipment is disclosed in German Patent DE-OS 38 22 900 which describes a core arranged between a top strap and a bottom strap. The ski also includes a cured single-component or multi-component synthetic resin part, a running surface and possibly reinforcement and/or damping inserts or steel edges. In this ski, the core is surrounded on all sides by the cured single-component or multi-component synthetic resin. By surrounding the core in this manner, the ski lacks some desired characteristics, due to the properties of the synthetic resin. In particular, the synthetic resin is better suited for producing the side walls or as an intermediate ply in the ski cross-section. This means that this type of production is only suitable for individual skis, which usually are not highly stress-resistant.

SUMMARY OF THE INVENTION

Accordingly, it is an object of the present invention to create a ski of the type mentioned above which demonstrates a high resistance to delamination.

It is a further object of the invention to provide a structure which can be easily adapted for different purposes.

These and other related objects are accomplished according to the present invention by providing a ski with a core located between a top strap and a bottom strap. The core is bonded to plies of the top and bottom strap by an adhesive plastic foam layer. The side walls on either side of the core are also formed of a plastic foam, the plastic foam adhesive layers and side walls encasing the core therebetween.

The use of plastic foam for the side walls makes possible perfect production of the side face even with different tolerances of the core. In addition, any dimensional tolerances in the core can be compensated without additional work processes. Therefore, after insertion of the top and bottom strap or the core, production of the side walls of the ski, which are visible from the outside, can take place in any desired form.

It is also advantageous that any desired ply of the top or bottom strap can be intimately bonded to the surface of the core which faces it. The foam plastic can be used as an adhesive material, and the bonding can be performed without any additional pressing process. This results in a high-strength bond created in a single work step. This bond can be used independent of the shape and the structure of the top or bottom strap or the core.

It was surprisingly found that it is possible to produce any ski independent of its area of use, by using the foam plastic for the side walls. By optionally fitting together these three parts (straps, cores, adhesive layers), the same production method can be used with pre-finished top and bottom straps or cores with different structures. This results in skis with a wide variety of properties and qualities. Furthermore, it is now also possible, in a single work step, to produce skis which do not require any subsequent processing of the side walls, such as milling or grinding.

It is desirable to produce a positive bond between the core, the top and bottom strap, and to produce the side walls, in a single work process.

The plies are formed by a mat, web, fleece, net or knit mesh, or fibrous materials (especially of glass, carbon or ceramic), with cavities between the individual fibers to receive plastic foam, especially in liquid form, which penetrates into the cavities between the individual fibers. This is due, in part, to capillary action. The foam can finish reacting and foaming after a pre-determined reaction time. This ensures uniform distribution of the plastic foam between the core and the top and bottom strap.

Ideally, the plies are formed by a fine, highly porous absorbent fleece. For example, the fleece can be saturated with the plastic foam in the liquid phase. In this manner, the most uniform possible foaming and reaction of the plastic foam can be achieved. As a result, no additional layer is required between the core and the top or bottom strap, in order to make uniform distribution of the plastic foam, which serves as an adhesive, possible.

Advantageously, the top surface of the core and/or the plies can be knurled. For example, they can be provided with a large number of small channels or cavities through which the liquid foam can penetrate. The liquid will coat a large area of the walls facing one another in order to achieve a sufficiently rupture-resistant bond between the layers.

In a further preferred embodiment, the core is of plastic material and its walls, particularly the walls facing the side walls, are provided with nubs or cross-ribs. In this manner, the layer thickness of the adhesive layer can be easily established. Due to the high pressure during foaming, the foam can penetrate the walls of the nubs and the plies of the top or bottom strap.

An additional layer can optionally be provided between the core and the plies. For example, this layer would be formed of a strip-shaped material, especially a steel strip, with corrugations or perforations or interruptions. This layer, used for distribution of the plastic in the adhesive layer, can also increase the bearing strength of the same.

Furthermore, the core can be produced from styrofoam and is preferably provided with cross-ribs or corrugations. Such material is inexpensive and easily formable. The depressions or cavities necessary for distribution of the foam plastic in the area of the adhesive layer can be easily molded.

The plastic foam can be, for example, a two-component system, especially polyurethane. Polyurethane provides a uniform layer over its entire surface which is independent of ambient conditions. Therefore, it allows perfect adhesion and good material homogeneity even in the area of the side walls. Ideally, the foam has a high modulus of elasticity and is elastically deformable. In this way, the plastic foam, without additional elements, can form the side walls and provide damping effects for stress caused by impacts at the edge of the ski. Advantageously, the foam eliminates the need for additional parts in the end of the ski. The plastic used for the side walls can also form the end protector.

In a further embodiment, at least parts of the side walls are formed from pre-finished profiles. As a result, different damping and strength characteristics can be achieved by choosing an appropriate profile insert in combination with a suitable design configuration.

Alternately, the side walls can be provided with convex recesses, e.g., labeling, patterns, et cetera. Such labeling or design configuration would remain clearly visible over a long period of use, even when the ski is subject to great stress. The labeling can be applied in finished quality, without additional processing steps.

Other objects and features of the present invention will become apparent from the following detailed description considered in connection with the accompanying drawings. It is to be understood, however, that the drawings are designed as an illustration only, and not as a definition of the limits of the invention.

BRIEF DESCRIPTION OF THE DRAWINGS

In the drawings, wherein similar reference characters represent similar elements throughout the several views:

FIG. 5 is an enlarged sectional view of another embodiment;

FIG. 6 is a cross-sectional view taken along line VI—VI in FIG. 5;

DETAILED DESCRIPTION OF THE PREFERRED EMBODIMENT

Figure 1:
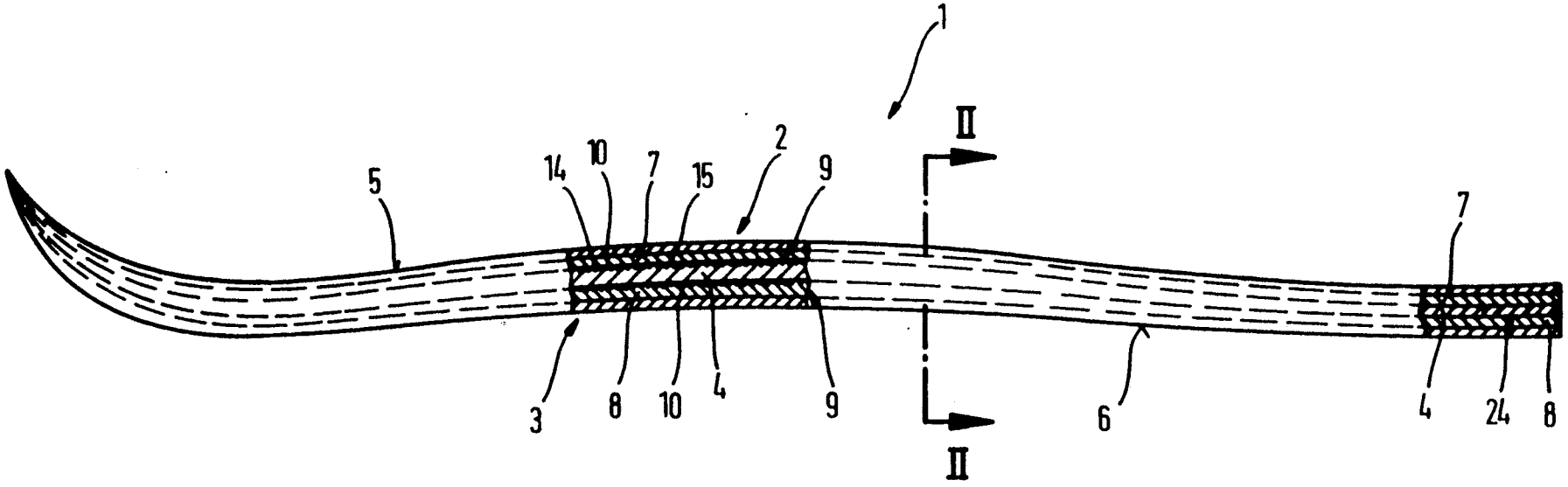
FIG. 1 is a side elevational view of a ski with adhesive layers according to the invention.

FIG. 1 shows a ski 1 which consists of a top strap 2 and a bottom strap 3, as well as a core 4 located between the straps. The top and bottom strap 2, 3, as well as the core can consist of several individual plies or layers, strips, profiles, et cetera. It can be made of a wide variety of materials, for example, sheet steel, aluminum, fiberglass-reinforced plastic mats, different plastic resins, or textile inserts. Also acceptable are mats of high-strength materials, for example, glass, carbon or ceramic fibers, which can be bonded to one another via their own adhesive layers or adhesive layers brought into the components. Such adhesive layers can be pressure and heat activated.

Top strap 2 is usually covered by a top surface coating 5, and bottom strap 3 by a running surface coating 6. The bond between core 4 and a ply 7 of top strap 2 or a ply 8 of bottom strap 3 adjacent to it is created by an adhesive layer 9.

Figure 2:
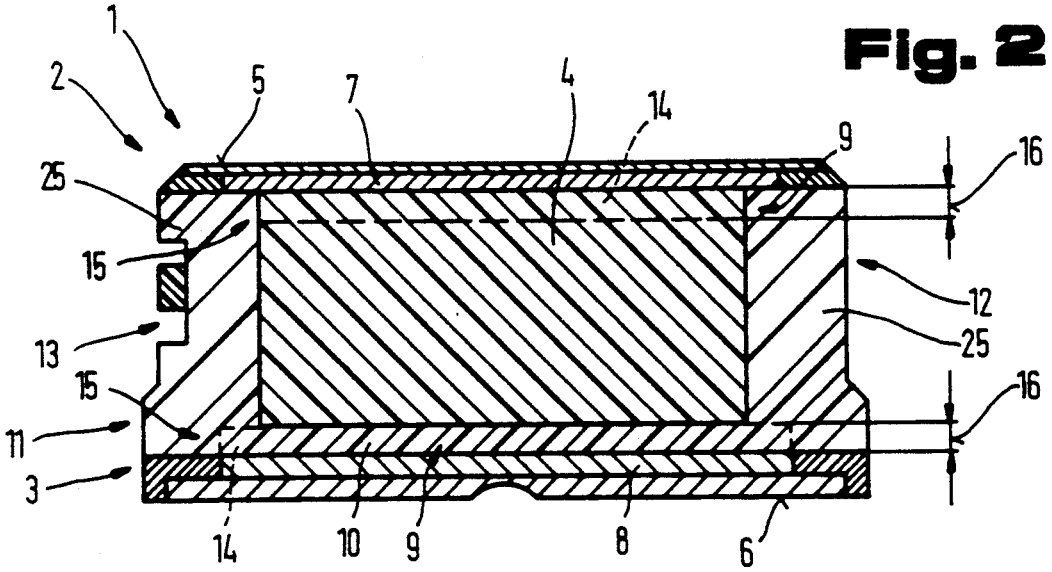
FIG. 2 is an enlarged sectional view taken along line II—II in FIG. 1.

As can be seen in FIG. 2, this adhesive layer 9 is formed by a foaming plastic 10, for example a two-component polyurethane or epoxy foam or similar material.

Plastic 10 also forms side walls 11, 12. Depending on the characteristics of the plastic 10 and the use of plasticizers or additives, its elastic properties can be adjusted in such a way to provide a damping effect in the ski edges.

It is now possible to produce differently structured top straps 2 or bottom straps 3 or cores 4 any of which can be bonded together with the same technology. In this way, skis 1 structured for different purposes can be produced by the same production means.

By manufacturing side walls 11, 12 out of plastic 10, it is also possible to create labeling 13 or even design configurations which are recessed into side walls 11, 12. This has the advantage that the design or the labeling 13 is maintained even when side walls 11, 12 are processed.

In order to allow the production of the adhesive layer 9 when the core 4 or straps 2, 3 are on top of each other, it is advantageous, if, for example, core 4—is provided with a cross-rib 14. Cross-rib 14 can be provided on the surface facing straps 2, 3, or, as shown in FIG. 2 only for the bottom ply 8. The walls of plies 7 and/or 8 facing the core 4, makes it possible for plastic 10 to penetrate between core 4 and straps 2, 3 in the channels or caverns 15 which run between these cross-ribs 14. The thickness of the adhesive layer 9, when cured, can be determined by a depth 16 of the caverns 15.

The cross section of cross-ribs 14 can be shaped so that they run to a point, for example, facing either straps 2, 3 or core 4. The proportion of the surface area of ply 7 or 8 facing core 4, with which plastic 10 comes into contact, ideally is several times the surface area with which the cross-ribs 14 rest against plies 7, 8 or core 4.

Figure 3:
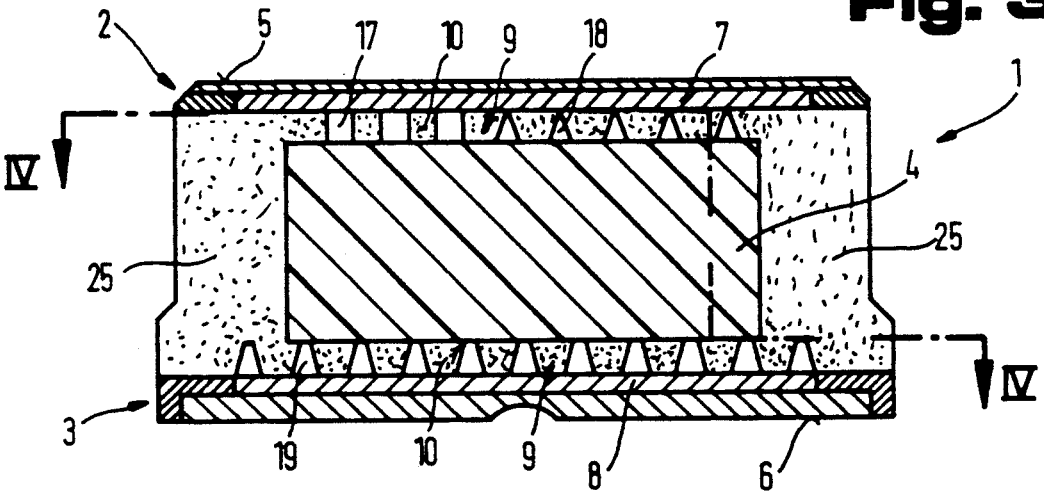
FIG. 3 is an enlarged sectional view of an alternate embodiment.

FIG. 3 shows that core 4, or plies 7 or 8, can be provided with nubs 17, 18 or 19 along the walls facing each other. Nubs can also be provided along the plies which do not face core 4, i.e., they extend beyond the width of core 4, as seen by two nubs 19 on opposite ends of ply 8. Core 4 is shown with nubs 17, 18.

Figure 4:
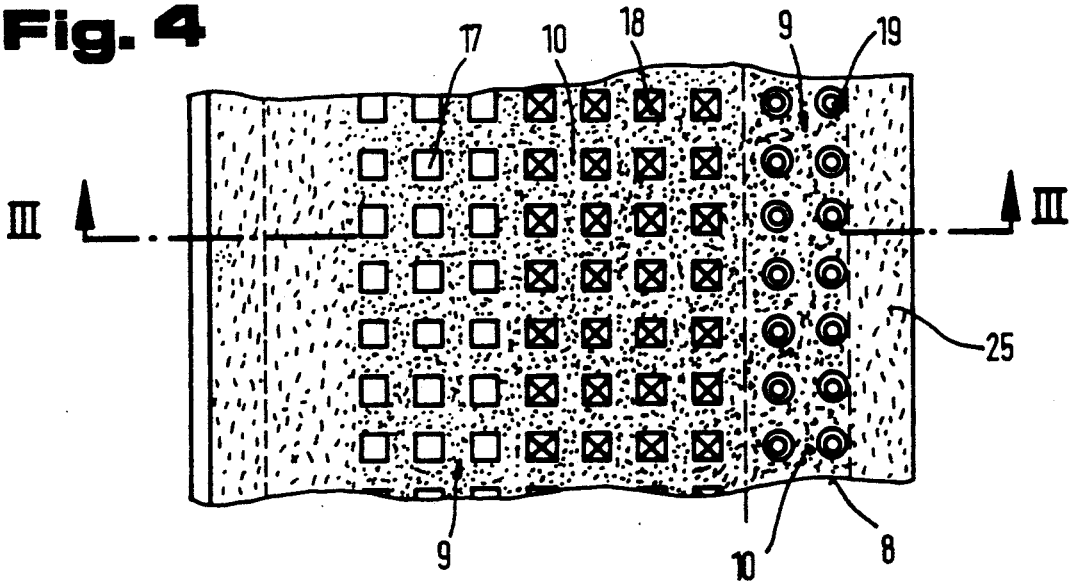
FIG. 4 is a cross-sectional view taken along line IV—IV in FIG. 3.

As shown in FIG. 4, nubs can be formed as small cubes (nubs 17), or by pyramids (nubs 18), or by truncated cones (nubs 19). Although FIGS. 3 and 4 show a mix of nub types, usually only one type of nub would be used for each ski. The only critical factor in the design of the nubs is that their surface area, which contacts plastic 10, should be significantly greater than the surface area that contacts core 4 and plies 7 and 8.

Accordingly, the structure of these nubs 17, 18 and 19 can have any other cross section desired which satisfies this criteria.

FIGS. 5 and 6 show an embodiment in which the caverns 20 are formed by a special structure of a mat, textile, deposit, or net. Also, threads 21, for example, made of glass, metal, carbon or ceramic, can be used. In the production of these textiles, mats, deposits, fleeces, nets or knit meshes, caverns 20 remain between individual threads 22 or bundles of such threads 21. Plastic 10 can penetrate caverns 20 lateral to the longitudinal direction of ski 1, between plies 7, 8, or layers. Plastic 10 can also penetrate between core 4 and plies 7, 8.

Figure 7:
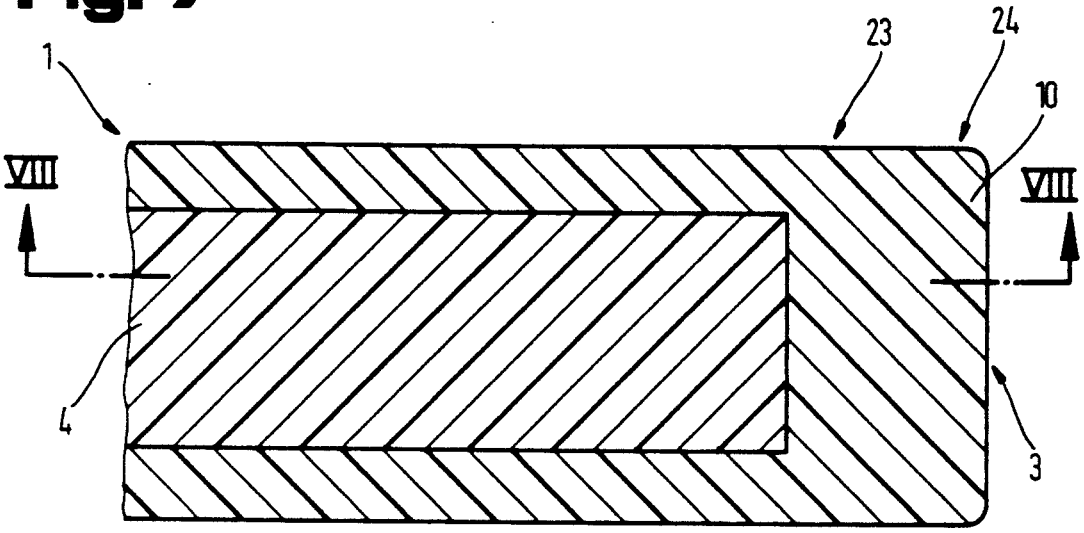
FIG. 7 is a plan view with the top strap removed.
Figure 8:
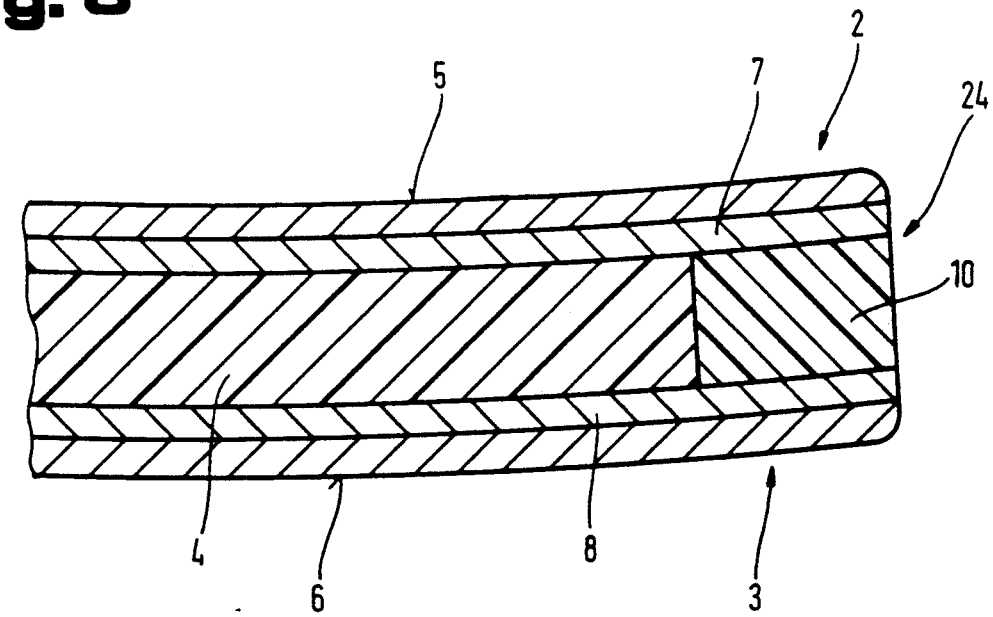
FIG. 8 is a side-elevational view taken along line VIII—VIII in FIG. 7.

FIGS. 7 and 8 show an alternate embodiment in an end area 23 of ski 1. The entire cavity between top strap 2 and bottom strap 3 can be filled with plastic 10 over the full width of the ski. With this full-surface filling of the cavity, a good bond between straps is assured. This prevents delamination even under extreme stress on the ski end, such as carrying the ski or placing it on a hard surface. The cavity, which is completely filled with plastic, acts as an end protector 24 in this case.

As shown in FIG. 2, it is possible to use different plastics. For example, plastic 10, which is injected between straps 2, 3 and core 4 can have a higher strength and a lower elasticity than the plastic 25 which is brought in subsequently. Plastic 25 can result in a better damping effect of the stress of impact which acts on the ski in the edge area or the area of the side walls 11, 12.

Plastic 10 and 25 can be introduced into the ski by consecutive injection processes.

Thus, while only a few embodiments of the present invention has been shown and described, it is obvious that many changes and modifications may be made thereunto, without departing from the spirit and scope of the invention.

What is claimed is:

1. A ski comprising:

a top strap including a top ply;

a bottom strap including a bottom ply;

a longitudinally extending core having a top and bottom disposed between said top and bottom plies, respectively;

plastic foam side walls extending longitudinally along the length of the ski and arranged on each side of said core;

a plastic foam adhesive layer bonding said core to said plies; and cross-ribs located between the top of said core and said top ply and between the bottom of said core and said bottom ply, said cross-ribs having channels formed therebetween which extend from one of said side walls to the other of said side walls, wherein said plastic foam adhesive layer penetrates the channels and has a thickness determined by the depth of the channels and wherein said plastic foam adhesive layer is the same material as said plastic foam side walls and both are formed in a single production step.

2. A ski according to claim 1, wherein said plies are made of a material selected from the group consisting of a mat, web, fleece, net mesh, knit mesh and fibrous materials, said materials including cavities between the individual fibers, said plastic foam adhesive layer penetrating into the cavities between the individual fibers.

3. A ski according to claim 1, wherein said cross-ribs are formed as part of said core.

4. A ski according to claim 1, wherein said cross-ribs are formed as part of said top and bottom plies.

5. A ski according to claim 1, wherein said core is provided with a knurled surface facing said plastic foam adhesive layer.

6. A ski according to claim 1, wherein said top and bottom plies are provided with a knurled surface facing said plastic foam adhesive layer.

7. A ski according to claim 1, wherein said cross-ribs are distributed over the surface of said core.

8. A ski according to claim 1, wherein additionally including a strip disposed within said plastic foam adhesive layer between said core and said top and bottom plies.

9. A ski according to claim 8, wherein said strip is a steel strip shaped and configured to provide an uneven surface for bonding to said plastic foam adhesive layer to increase the bearing strength of said plastic foam adhesive layer.

10. A ski according to claim 1, wherein said core is a styrofoam core.

11. A ski according to claim 1, wherein said top and bottom strap are made from a material selected from the group consisting of sheet steel, aluminum, fiberglass-reinforced plastic mats, plastic resin, and textile inserts.

12. A ski according to claim 1, wherein said plastic foam adhesive layer is made from a material selected from the group consisting of a two-component polyurethane and epoxy foam.

13. A ski according to claim 1, wherein said plastic foam adhesive layer includes a variable amount of plasticizers to adjust the elastic properties of said plastic foam adhesive layer to provide a damping effect in the ski edges.

14. A ski according to claim 1, additionally including a label recessed into said plastic foam side walls.

* * * * *